US008360277B2

(12) United States Patent
Rasmussen

(10) Patent No.: US 8,360,277 B2
(45) Date of Patent: Jan. 29, 2013

(54) ASSEMBLY FOR DISPENSING BEVERAGE

(75) Inventor: Jan N. Rasmussen, Ølstykke (DK)

(73) Assignee: Carlsberg Breweries A/S, Copenhagen (DK)

( * ) Notice: Subject to any disclaimer, the term of this patent is extended or adjusted under 35 U.S.C. 154(b) by 717 days.

(21) Appl. No.: 12/063,509

(22) PCT Filed: Aug. 10, 2006

(86) PCT No.: PCT/DK2006/000435

§ 371 (c)(1),
(2), (4) Date: Mar. 25, 2010

(87) PCT Pub. No.: WO2007/019848

PCT Pub. Date: Feb. 22, 2007

(65) Prior Publication Data

US 2010/0181338 A1 Jul. 22, 2010

(30) Foreign Application Priority Data

Aug. 12, 2005 (DK) ..... 2005 01147
Mar. 14, 2006 (DK) ..... 2006 00363

(51) Int. Cl.
*B67D 1/00* (2006.01)
*B65D 35/56* (2006.01)
*B65D 83/00* (2006.01)

(52) U.S. Cl. .... 222/83.5; 222/105; 222/131; 222/386.5; 222/394

(58) Field of Classification Search ..... 222/83, 222/83.5, 95, 105, 131, 386.5, 394, 399
See application file for complete search history.

(56) References Cited

U.S. PATENT DOCUMENTS

| | | | | |
|---|---|---|---|---|
| 4,921,135 | A * | 5/1990 | Pleet | 222/82 |
| 5,240,144 | A | 8/1993 | Feldman | |
| 5,251,787 | A * | 10/1993 | Simson | 222/95 |
| 6,375,048 | B1 * | 4/2002 | van der Meer et al. | 222/396 |
| 6,824,017 | B2 * | 11/2004 | Sluijter | 222/153.04 |
| 7,188,751 | B2 * | 3/2007 | Van Der Klaauw et al. | 222/146.6 |
| 7,604,147 | B2 * | 10/2009 | Anderson | 222/400.7 |
| 7,810,679 | B2 * | 10/2010 | Wauters et al. | 222/399 |
| 2003/0062383 | A1 * | 4/2003 | Meike et al. | 222/95 |
| 2003/0071067 | A1 * | 4/2003 | Sluijter | 222/183 |
| 2003/0173376 | A1 | 9/2003 | Bilskie et al. | |
| 2004/0007589 | A1 * | 1/2004 | Leveen | 222/95 |
| 2006/0186136 | A1 * | 8/2006 | Wauters et al. | 222/105 |
| 2010/0176149 | A1 * | 7/2010 | Rasmussen | 222/54 |
| 2010/0252583 | A1 * | 10/2010 | Maas et al. | 222/386.5 |

FOREIGN PATENT DOCUMENTS

| | | |
|---|---|---|
| WO | WO 2004/050539 | 6/2004 |
| WO | WO 2004/099060 | 11/2004 |

* cited by examiner

*Primary Examiner* — Kevin P Shaver
*Assistant Examiner* — Patrick M Buechner
(74) *Attorney, Agent, or Firm* — Klein, O'Neill & Singh, LLP

(57) ABSTRACT

An assembly for dispensing a beverage includes a collapsible beverage container having a neck part with an outlet. A connecting element is arranged at the neck part so as to receive an inlet end of a dispensing line. The beverage container is contained in a pressure chamber having an interior configured to accommodate the beverage container and a lid. The connecting element is configured for abutment with the lid of the pressure chamber to form a seal between the lid and the beverage container during use.

19 Claims, 10 Drawing Sheets

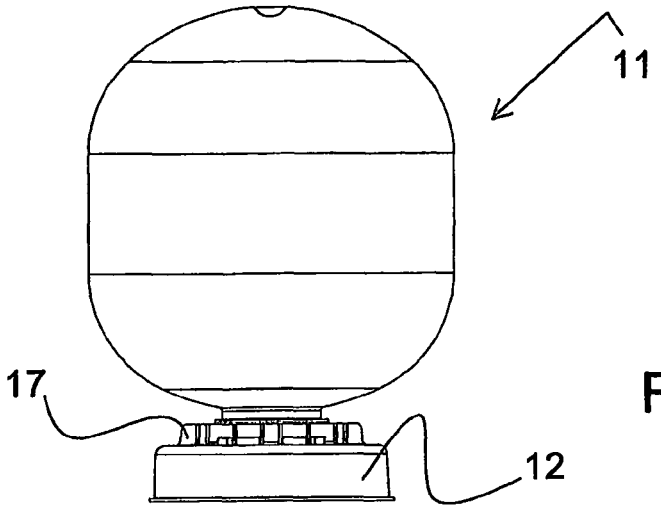
Fig. 5
Fig. 6
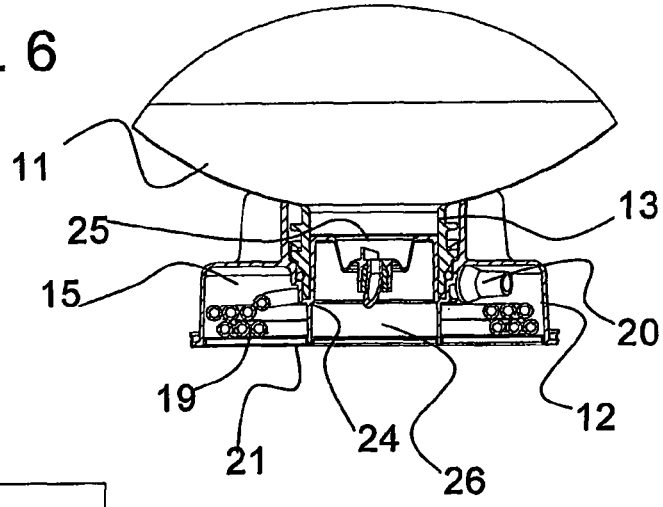
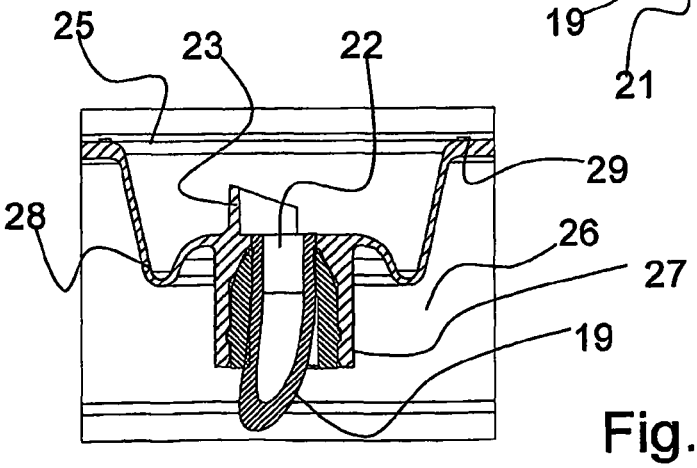
Fig. 7

Fig. 8
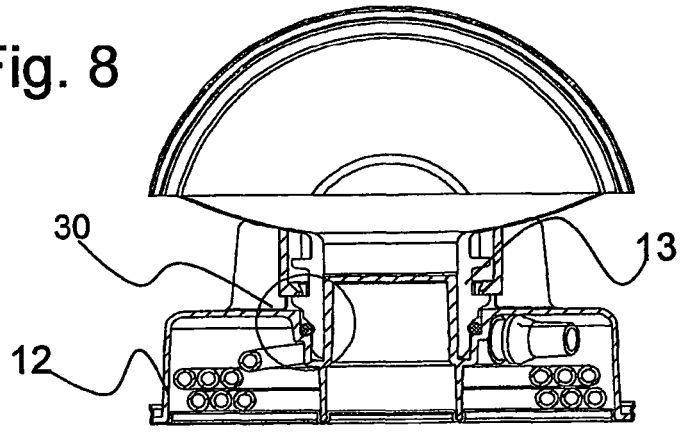
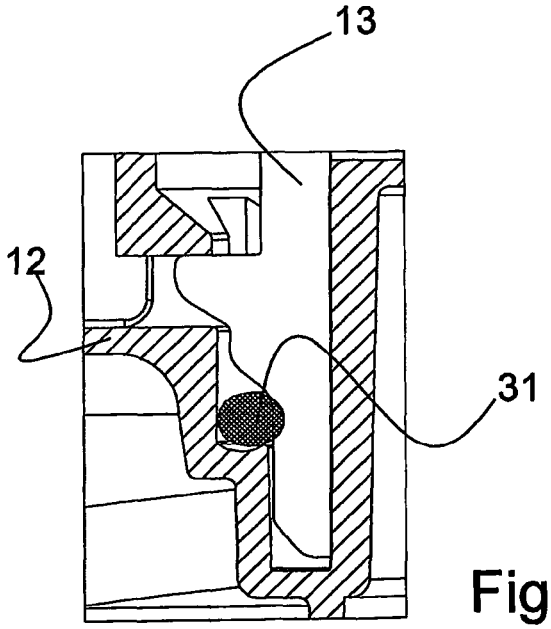
Fig. 9

ASSEMBLY FOR DISPENSING BEVERAGE

CROSS REFERENCE TO RELATED APPLICATION

This application is the national phase entry. under 35 U.S.C. §371(c). of co-pending International Application No. PCT/DK2006/000435, filed Aug. 10, 2006, the disclosure of which is incorporated herein by reference in its entirety.

FEDERALLY SPONSORED RESEARCH OR DEVELOPMENT

Not Applicable

FIELD OF THE INVENTION

The present invention relates to an assembly for dispensing a beverage, said assembly comprising a pressure chamber, which is adapted during use to accommodate a beverage container. The beverage container is made of a collapsible material and comprises a neck part having an outlet. Furthermore, a connecting element is arranged at the neck part of the beverage container, where said connecting element comprises means for receiving an inlet end of a dispensing line, and said pressure chamber comprises a wall and a lid defining the accommodation for the beverage container.

BACKGROUND ART

Large-volume carbonated beverages, such as draught beer, are conventionally delivered to the place of consumption in metal kegs that typically hold a large volume of e.g. 25 litres. Such kegs are intended for expensive and elaborate dispensing assemblies comprising draught beer coolers, carbondioxide cartridges, etc., for cooling and dispensing the beverage from the container. Such kegs and dispensing assemblies are well known in the art.

The metal kegs are heavy, and thus difficult to handle, and cause excessive transportation costs. Furthermore, metal kegs have high manufacturing costs, and need to be collected for refilling after complete or partial emptying.

A keg is reused several times before it is scrapped. Consequently, kegs travel long distances in their life-time and the heavier they are the higher the transportation cost is. Additionally, the consumption of draught beer is very sensitive to seasonal variation. Especially in summer periods consumption is high, while in colder periods consumption is low. Therefore, to be able to meet the demand a large number of kegs must be in circulation causing storage of plenty of empty kegs during periods of low consumption.

Another disadvantage of the known draught beer assemblies is that many parts that are in contact with the beverage are reused and therefore require regular cleaning in order to keep the parts hygienically clean and to prevent bacteria growth. The cleaning is time consuming and it may be difficult to perform sufficiently thorough cleaning of all the parts. If the parts that are in contact with the beverage are not cleaned thoroughly it will influence the quality of the beverage.

To overcome some of these disadvantages beverage containers for dispensing assemblies produced in lighter, more flexible materials have been introduced. Plastic bags emptied by pressing out the content mechanically, pneumatically or hydraulically have been tested, but are too fragile for most practical purposes.

Also dispensing from collapsible beverage bottles made of plastic materials, e.g. PET, are known in the art. These bottles are emptied by collapse of the bottle wall by application of mechanical, pneumatic or hydraulic pressure causing the content to be squeezed out. Such beverage bottles contain only small volumes, such as a few litres, and are not directly comparable to metal kegs, which hold a substantially larger volume of beverage. However, the collapsible bottles have a number of advantages over metal kegs in many aspects.

Plastic materials can be ground up, and the resulting granulate can be used in production of new plastics materials. The granulate takes up little space. thus eliminating the need for large storage. Since the bottles are lighter, they are easier to handle and involve smaller transportation costs. Plastic bottles can be made transparent to allow visual inspection of the content or they can be dyed in any desired color. When emptied the bottle is collapsed and will take up little space during transportation for recycling.

A dispensing assembly with a collapsible beverage bottle is for example known from EP-A1-1 003 686. This apparatus constitutes an integrated dispensing device comprising a housing with a lid, sealing means, a pressure source, a cooling device and a dispensing tap. The dispensing apparatus has a complicated design, comprising a vast number of parts, the parts themselves being elaborate, costly devices. There is thus a need for providing an assembly for dispensing beverage which has a simple design and construction wherein beverage containers even though being relatively heavy easily may be handled by an user.

Furthermore, due to government regulations, environmental concerns, and material costs is desired to recycle the bottle when it is emptied. and to dispose and replace other elements at the same time as the bottle is being replaced. This is often done by collecting and grinding the plastics material bottles, as well as other elements. In view of environmental concerns, and for economic reasons as well, there is a need to develop elements and parts for single-use in an assembly for dispensing beverage, and to make these parts or elements as small as possible, both in size and weight, without compromising the functionality, security, or durability of the parts and elements.

SUMMARY OF THE INVENTION

An object of the present invention is to wholly or partly overcome the above disadvantages and drawbacks of the prior art.

The above object, together with numerous other objects, advantages and features, which will become evident from the below description, is accomplished by a solution in accordance with the present invention by which the connecting element are adapted for abutment with the lid of the pressure chamber so that a sealing between the lid and beverage container is obtained during use.

Advantageously, the overall width of the connecting element is smaller than the width of the beverage container so that consumption of material for the production of the connection elements is kept at a minimum.

According to the invention the connecting element may comprise a disc shaped part, said disc shaped part having a first and a second surface and a wall part, said wall part being arranged circumferential to and extending from the second surface as well as substantially perpendicular to the second surface.

In a preferred embodiment of the invention, the first surface of the disc shaped part of the connecting element may comprise locking means adapted to securely connect the connecting element to the neck of the beverage con- tainer. Said locking means may expediently comprise a first annular space arranged between an outer circular wall and an inner circular wall, said outer wall and said inner wall being arranged concentrically.

In addition, said first annular space may extend through the disc shaped part thereby providing an enhanced rigid connection between the connecting element and neck part of the beverage container, so that bending of the disc shaped part of the connecting element substantially does not influence the locking means.

According to the invention the outer circular wall may comprise an inward surface and an outward surface, and the inward surface may comprise projections which are adapted to go into secure engagement with projections arranged on the outer side of the neck.

Advantageously, the outward surface of the outer circular wall may comprise supporting means which are adapted to support the outer wall in a radial direction so that a rigid as well as secure connection between the neck part and connecting element is achieved. Hereby is obtained that the connection between the neck part and the connecting element can withstand a pressure of up to 7 bar. The supporting means may consist of a plurality of ribs arranged around the outer wall.

Furthermore, the locking means may comprise sealing means for avoiding leakage of beverage via the locking means.

In expedient manner the inner circular wall may be adapted to be inserted into the outlet of the beverage container.

In a preferred embodiment according to the invention a gastight membrane may be arranged in connection with the inner circular wall, thereby completely sealing the beverage container. The membrane may preferably withstand a pressure of 7 bar.

Optionally, a second membrane may be arranged as a part of the connecting element. Such a second membrane may provide additional sealing of the beverage container and may be preferable when incorporating the beverage container into existing beverage dispensing systems.

According to the invention a piercer may be arranged inside the inner circular wall in a predetermined distance from the membrane, said piercer being adapted to pierce the membrane when a predetermined pressure is obtained inside the pressure chamber. The piercer may be an integrated part of the connection element or a separate part, which is adapted to be connected to the connection element.

The inlet end of the dispensing line may be arranged in connection with the piercer. In an embodiment of the invention the inlet end of the dispensing line may be obliquely cut so that the oblique end of the dispensing line is the piercer.

Furthermore, the second surface of the disc shaped part may comprise an inner circular wall part, said inner circular wall part being arranged inside said wall part whereby a second annular space is arranged between said wall parts. The inner circular wall part may define a compartment, wherein the receiving means for the inlet of the dispensing line is arranged.

According to a preferred embodiment of the invention the receiving means may be arranged in connection with a flexible collar, said collar during use being adapted to move the piercer into a piercing position when the predetermined pressure is obtained inside the pressure chamber.

Advantageously, the second annular space may be adapted to engage with corresponding means arranged at the inside of the lid of the pressure chamber.

Also, a sealing element may be arranged in the second annular space for sealing between the lid and the connecting element.

The connecting element may be made of plastic materials, such as PET, PE, PBT or PP or a combination thereof.

The invention is also new and inventive by providing a beverage container made of a collapsible material and comprising a neck part having an outlet, a connecting element being arranged at the neck part of the beverage container, said connecting element comprising means for receiving an inlet end of a dispensing line.

Preferably, the beverage container may be connected to a lid of a pressure chamber by means of the connecting element, thereby obtaining a sealing between the lid and beverage container.

BRIEF DESCRIPTION OF THE DRAWINGS

The invention and its many advantages will be described in more detail below with reference to the accompanying schematic drawings, which for the purpose of illustration show some non-limiting embodiments and in which

FIG. 5 shows in a side view an embodiment of a beverage container, FIG. 6 shows a sectional view of a connecting element with a coiled up dispensing line, FIG. 7 shows in a detailed sectional view the inlet end of the dispensing placed in the connecting element and a piercer, FIG. 8 shows a sectional view of a connecting element with a coiled up dispensing line, FIG. 9 shows an enlarged sectional view of the encircled area in FIG. 8 and illustrates the placement of a sealing device between the beverage container and the connecting element.

All the figures are highly schematic and not necessarily to scale, and they show only parts which are necessary in order to elucidate the invention, other parts being omitted or merely suggested.

DESCRIPTION OF PREFERRED EMBODIMENTS

Figure 1:
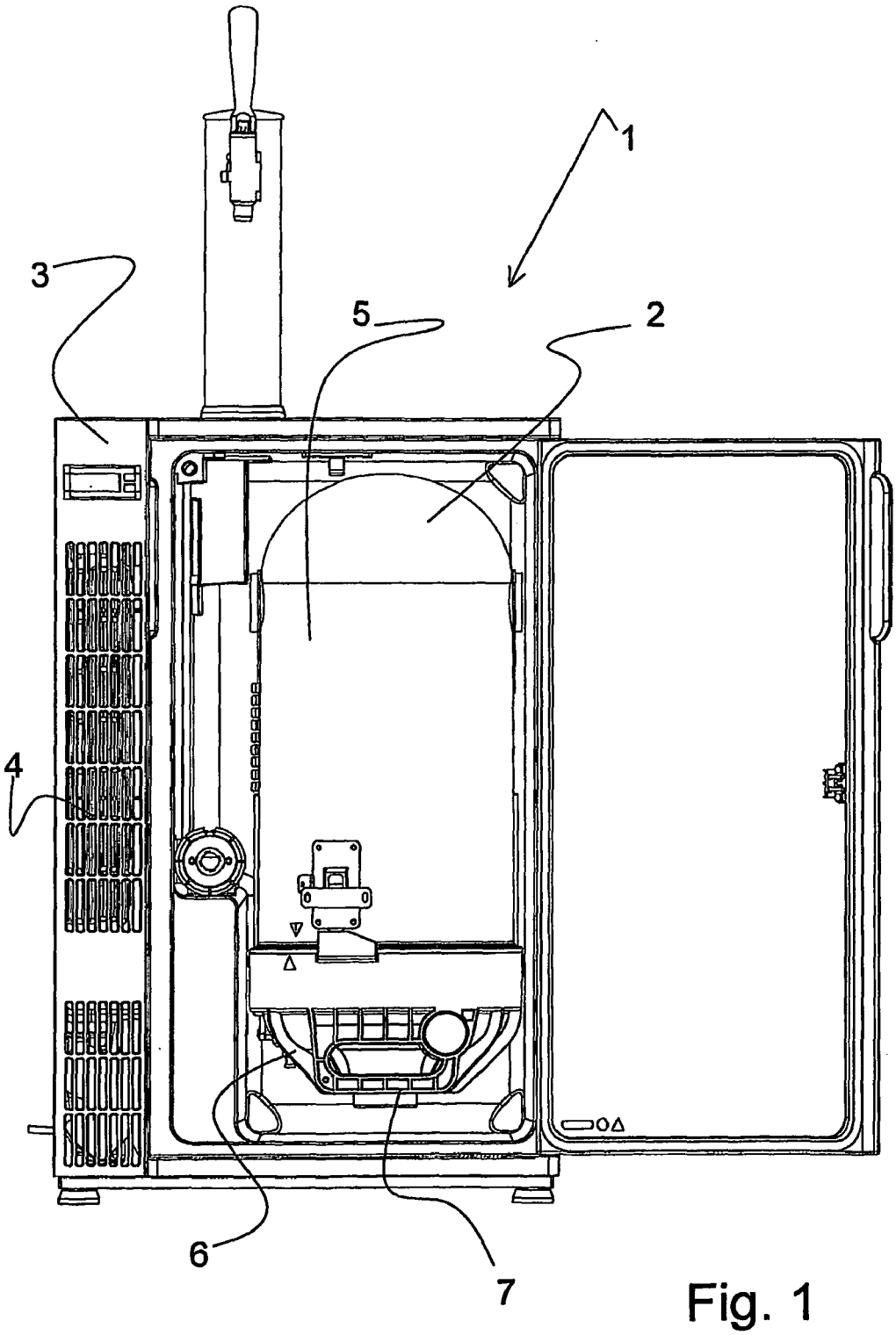
FIG. 1 shows in a front view an embodiment of an assembly for dispensing beverage according to the invention.

In FIG. 1 one embodiment of the assembly 1 according to the invention is shown schematically in a front view. In this embodiment the assembly 1 comprises a heat transfer system (not shown). It is within the inventive idea that the heat transfer system may be adapted to provide cooling or heating to at least a pressure chamber 2 of the assembly 1. The pressure chamber 2 is adapted during use to accommodate a beverage container (not shown), wherefore the heat transfer system may cool or heat the beverage contained inside the beverage container.

The beverage may be beer, soft drinks, wine, tea, coffee, or the like, thus, the assembly is adapted to provide the right cooling or heating for the specific beverage, so that when said beverage is being served it has the right temperature for the consumer.

In the following description the heat transfer system will be explained in connection with a cooling system, however, it may as well be a heating system or a combination thereof.

The assembly 1 shown in FIG. 1 further comprises a cooling unit 3 in the form of a refrigerator, wherein the pressure chamber 2 is contained. The cooling unit 3 comprises, as a refrigerator, cooling elements as well as ventilation means for circulating the cooled air inside the cooling unit 3. These elements are hidden behind the ventilation gratings 4 shown in the left side of the assembly 1.

The pressure chamber 2 comprises a wall or cover and a lid 6 defining the accommodation for the beverage container (not shown).

The pressure chamber 2 is furthermore provided with a pressure source (not shown), said pressure source being adapted to provide a predetermined pressure to the pressure chamber 2. Furthermore, a pressure-controlling unit may be arranged in connection with said pressure source and the pressure chamber 2.

The lid 6 in this embodiment is detachable from the pressure chamber 2. however, in other embodiments it may be pivotably attached to the pressure chamber. The lid 6 may be locked to the chamber by closing means such as by threading, by a bayonet closure or screw shackle lock. Furthermore, the lid 6 comprises an opening (not shown), which preferably is substantially at the center of the lid 6. Through said opening a dispensing line is connected to the beverage container when the beverage container is accommodated in the pressure chamber 2.

The pressure chamber 2 in FIG. 1 is shown in an operating position, which in this embodiment is equal to a vertical orientation of said pressure chamber 2. The lid 6 is placed at the bottom of the pressure chamber 2 and comprises a handle 7, which facilitates handling of the pressure chamber 2.

Figure 2:
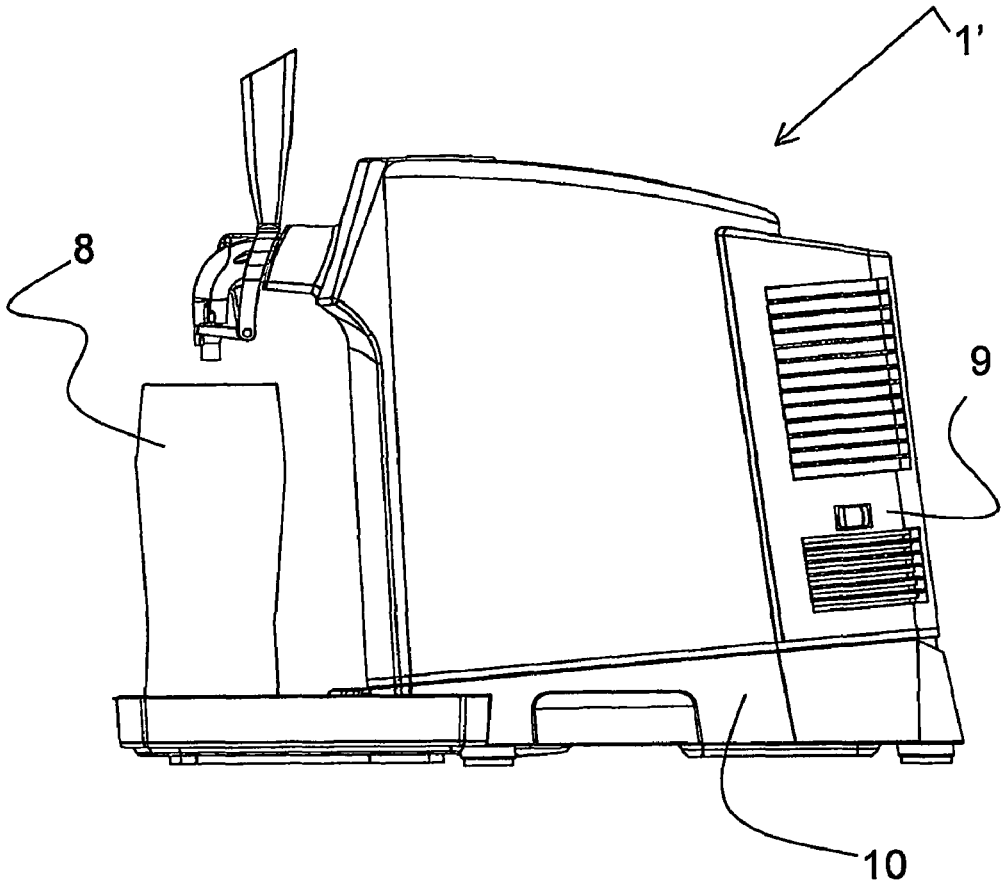
FIG. 2 shows in a side view another embodiment of an assembly for dispensing beverage according to the invention.

In FIG. 2, another embodiment of assembly 1' according to the invention is shown in a side view. This embodiment illustrates a home dispensing assembly, wherein the pressure chamber (not shown) may accommodate a beverage container containing about 5 litres. The assembly 1' is shown here in a use position ready for dispensing the beverage into a glass 8. Due to the compactness of this assembly 1', the pressure chamber also serves as the cooling unit. The assembly l comprises a top part 9 and a bottom part 10.

Figure 3:
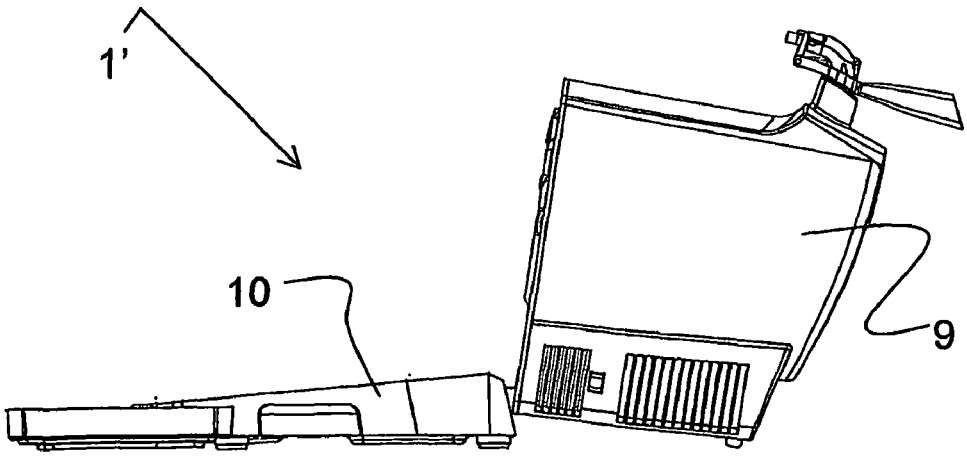
FIG. 3 shows, in a side view, the assembly of FIG. 2, wherein a top part has been pivoted.

FIG. 3 illustrates the assembly 1' of FIG. 2 in a loading position. In this position, the top part 9 is pivoted away from the bottom part 10. When the top part 9 is pivoted, the pressure source (not shown) is disconnected from the pressure chamber, which is contained in the top part 9. Hereinafter it is possible to open the pressure chamber for unloading an empty beverage container and loading a new filled one.

Subsequently, the pressure chamber is closed and the top part 9 is pivoted back for connection with the bottom part 10 and thereby the pressure source, which immediately will start to build-up pressure in the pressure chamber for enabling dispensing.

Figure 4:
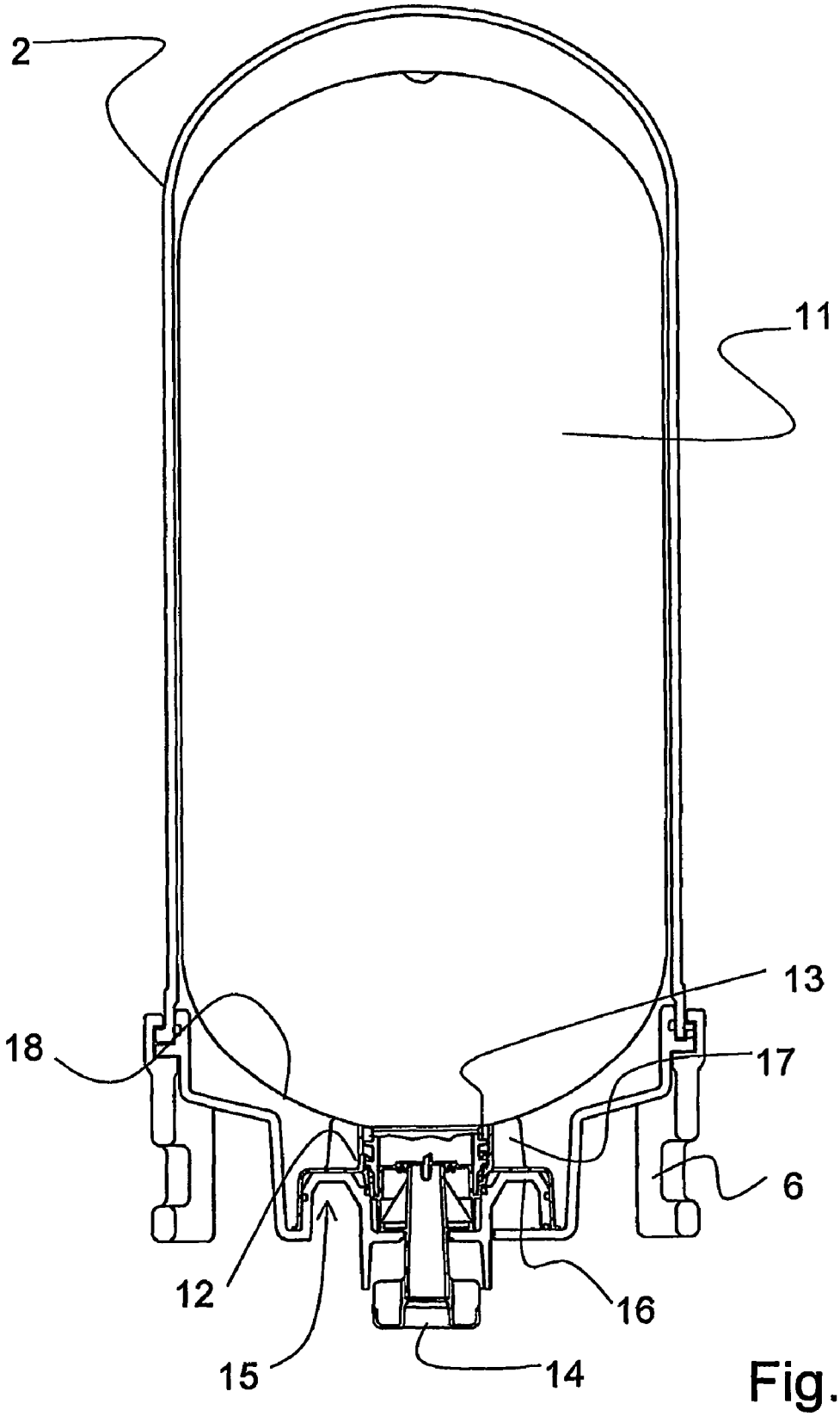
FIG. 4 shows in a side cross-sectional view a pressure chamber of the assembly shown in FIG. 1.

In FIG. 4 the pressure chamber 2 is shown in a cross-sectional side view with a beverage container 11 placed in the pressure chamber 2. The beverage container 11 is placed upside-down and the pressure chamber 2 is in this vertical position ready for use. The beverage container 11 comprises a connecting element 12 according to the invention. The connecting element 12 is arranged at a neck part 13 of the beverage container 11. The neck part 13 comprises the inlet/outlet of the beverage container. The connecting element 12 is adapted for abutment with the lid 6 of the pressure chamber 2 so that a sealing between the lid 6 and beverage container 11 is obtained during use. The connecting element 12 also aligns the opening 14 of the lid 6 with the inlet end of the dispensing line (not shown) and connects the inlet end of the dispensing line to the outlet of the beverage container 11.

The connecting element 12 comprises a second annular space 15 which engages corresponding connecting means 16 arranged at the inside of the lid 6 of the pressure chamber 2.

The supporting means of the connecting element 12, here in the form of ribs 17, are in this embodiment shown as also supporting the shoulder part 18 of the beverage container 11.

In FIG. 5 is an embodiment of a beverage container 11 according to the invention shown. At the outlet end of the beverage container 11 the connection element 12 is arranged. FIG. 5 shows an embodiment wherein the ribs 17 are not supporting the shoulder part of the beverage container. Furthermore, the overall width of the connecting element 12 is smaller than the width of the beverage container 11.

The beverage container 11 is preferably manufactured from plastics, particularly a polymer, such as PEN or PET or blended PET. Thus, the beverage container 11 can be formed as a thin-walled, self-supporting structure that is suitable for collapsing when an external pressure is applied to the pressure chamber. The beverage container 11 can be manufactured as a multilayer construction comprising an oxygen barrier for preserving the beverage content of the beverage container. Furthermore, the beverage container 11 can be tinted or dyed to create a barrier to light, in case the beverage quality is sensible to light. Such a light barrier could be placed in the oxygen barrier. Other suitable processes are coating the beverage container 11, e.g. plasma coating the interior surface and/or epoxy-coating the exterior surface.

The beverage containers 11 can be transported separately to the site of filling. Usually such beverage containers 11 are not blown to their full size until immediately before their filling with beverage. At the production site the beverage containers 11 are blown to their full size, the container 11 having a bottom part, a middle part with a generally cylindrical wall, a shoulder part and a neck part constituting an inlet and outlet. After blowing the beverage container 11 into shape the container 11 is filled with the desired beverage and closed by pressing the connecting element 12 over the neck. Thus, the connecting element 12 may function as closure of the beverage container.

Preferably, the connection between the connecting element 12 and the beverage container 11 is of such a nature that once the connecting element 12 has been secured to the beverage container 11 it cannot be removed without damaging the beverage container 11 and/or the connecting element 12, thus providing a tamperproof container unit containing beverage ready to be delivered to the place of consumption. Such an inseparable connection can be obtained in a variety of ways. Preferably the connection is obtained by press fitting the connecting element 12 over the neck of the beverage container 11, the neck and connecting element 12 being provided with cooperating locking means, which will be explained further below.

In FIG. 6 the connecting element 12 is shown in a cross-sectional side view connected to the neck part 13 of the beverage container 11. In this embodiment the dispensing line 19 is shown coiled up and placed inside the second annular space 15 of the connecting element 12. In connection with the dispensing line 19 is a dispensing valve 20 arranged. Over the bottom of the connection element 12 is a cover 21 arranged for protecting the dispensing line during transportation. FIG. 7 is an enlarged area of the connecting element 12 of FIG. 7 showing that the inlet end 22 of the dispensing line 19 is arranged in connection with a piercer 23. The piercer 23 is in this embodiment an integrated part of the connecting element 12. The piercer 23 is arranged inside the inner circular wall 24 (see FIG. 6) at a predetermined distance from a gastight membrane 25, which is arranged in connection with the inner circular wall 24. During operation of the assembly the piercer 23 is adapted to pierce the membrane 25 when a predetermined pressure is obtained inside the pressure chamber 2.

The inner circular wall 24 defines a compartment 26, wherein the receptacle 27 for the inlet 22 of the dispensing line 19 is arranged. The receptacle 27 is arranged in connection with a flexible collar 28, said collar 28 during use being adapted to move the piercer 23 into a piercing position when the predetermined pressure is obtained inside the pressure chamber. The collar 28 is in this embodiment connected with the inner circular wall 24 via an annular flange 29 arranged at the top of the inner circular wall 24. In this embodiment the flange 29, the collar 28 and the receptacle 27 provide a sealing so that when the membrane 25 is pierced the beverage will only be led through the inlet 22 of the dispensing line 19. The flange 29 is furthermore providing an upper surface whereupon the membrane 25 is placed, thereby enhancing the attachment of the membrane to the connecting element as well as the resistance to pressure.

In a not shown embodiment of the invention, the piercer may be a separate part which is adapted to be connected to the connecting element 12. For instance, the inlet end of the dispensing line may be obliquely cut so that the oblique end of the dispensing line acts as the piercer.

FIG. 8 also shows the connecting element 12 in a cross-sectional side view. The encircled area 30 is shown enlarged in FIG. 9 and illustrates in detail the connection between the neck part 13 of the beverage container and the connecting element 12. The locking means of the connecting element 12 may comprise projections, which are adapted to go into secure engagement with projections arranged on the outer side of the neck. These projections may be in engagement with projections arranged on the outer side of the neck. These projections may be in the shape of taps/barbs and recesses/collars as indicated in FIGS. 8 and 9 or any other kind of snap mechanism. As an alternative to the shown embodiment, the connecting element 12 can be glued or welded to the neck of the beverage container 11, or the connecting element 12 could be screwed onto the neck of the beverage container 11, provided the thread is equipped with means for preventing release of the connecting element 12.

Between the neck 13 of the beverage container and the connecting element 12, a sealing ring 31 is arranged. The sealing ring 31 prevents any leakage of beverage during normal use, as well as sealing off when mutual displacement of the beverage container and the connecting element occurs.

Figure 10:
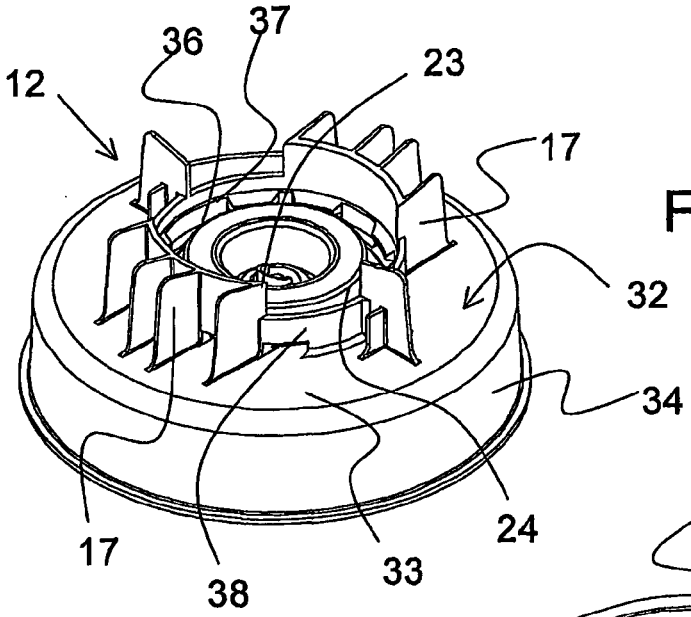
FIG. 10 shows in perspective the top side of the connecting element.

In FIG. 10 the connecting element 12 is shown in perspective from above. The connecting element 12 comprises a disc shaped part 32, said disc shaped part 32 having a first surface 33 and a second surface 35 (see FIG. 11) and a wall part 34. The wall part 34 being arranged circumferential to and extending from the second surface 35 as well as substantially perpendicular to the second surface 35, thereby providing a housing.

In the first surface 33 of the disc shaped part 32 of the connecting element 12 locking means 36 is adapted to securely connect the connecting element 12 to the neck part of the beverage container. The locking means 36 comprises a first annular space 37 arranged between an outer circular wall 38 and an inner circular wall 24, said outer wall 38 and said inner wall 24 being arranged concentrically. The first annular space 37 having a width, which is a little smaller than the thickness of the neck part of the beverage container for enabling the press fitting and locking.

The outward surface of the outer circular wall 38 comprises supporting means 17 which are adapted to sup- port the outer wall 38 in a radial direction so that a rigid as well as secure connection between the neck part and connecting element 12 is achieved. The supporting means consist of a plurality of ribs 17 arranged around the outer wall 38. The matter is that the ribs 17 support the wall 38 and thereby the neck of the beverage container and secure a rigid engagement between the connection element 12 and the neck of the beverage container. It should be mentioned that when the connecting element 12 is mounted on the beverage container, the connecting element 12 may be used as a handle, thereby facilitating the handling of the cylindrical beverage container for the user. Therefore, it is of major importance that the engagement between the beverage container and the connecting element is as rigid as possible. Said ribs 17 may furthermore extend up to the shoulder of the beverage container for supporting this.

Inside the inner wall 24 the integrated piercer 23 is shown. FIG. 10 does not show the membrane, which would have been arranged over the piercer 23.

Figure 11:
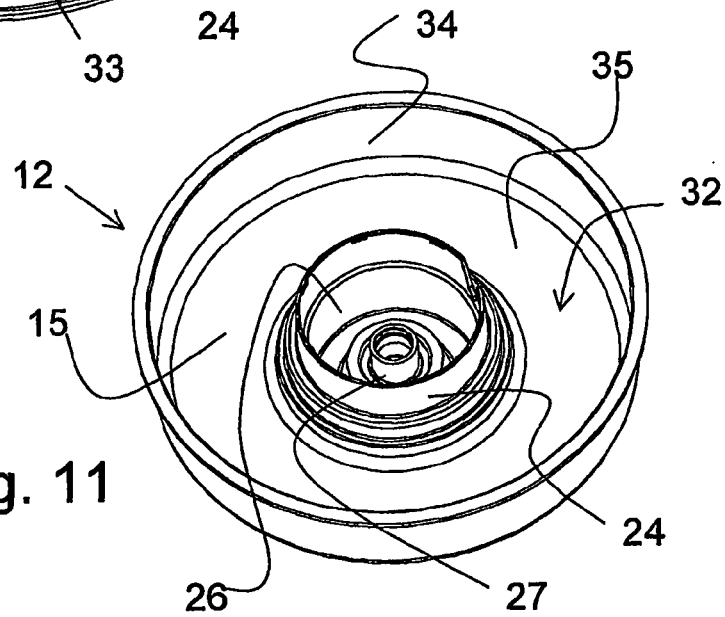
FIG. 11 shows in perspective the bottom side of the connecting element.

In FIG. 11 the connecting element 12 is shown in perspective from below. The second surface 35 of the disc shaped part 32 comprises the inner circular wall 24, said inner circular wall 24 is arranged inside said wall part 34 whereby a second annular space 15 is arranged between said wall part 34 and said wall 24. This second annular space 15 may be used as storage for a coiled up dispensing line as shown in FIG. 6 and may in a use situation engage corresponding means arranged at the inside of the lid of the pressure chamber as shown in FIG. 4. Furthermore, a sealing element (not shown) may be arranged in the second annular space.

The inner circular wall 24 defines a compartment 26, wherein the receiving means 27 for the inlet of the dispensing line is arranged.

Figure 12:
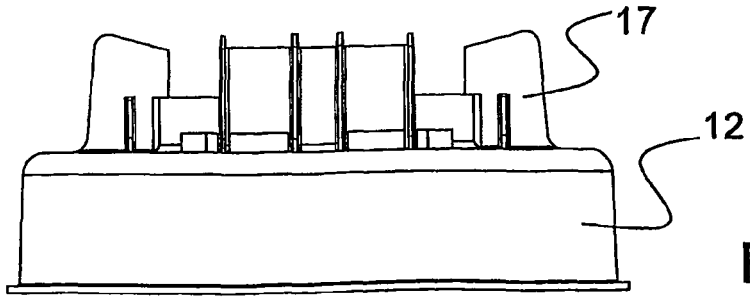
FIG. 12 shows in a side view the connecting element.
Figure 13:
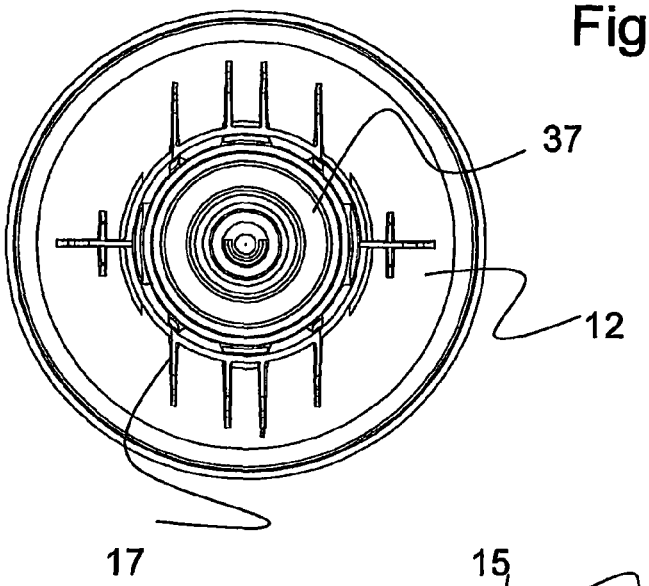
FIG. 13 shows in a top view the connecting element.
Figure 14:
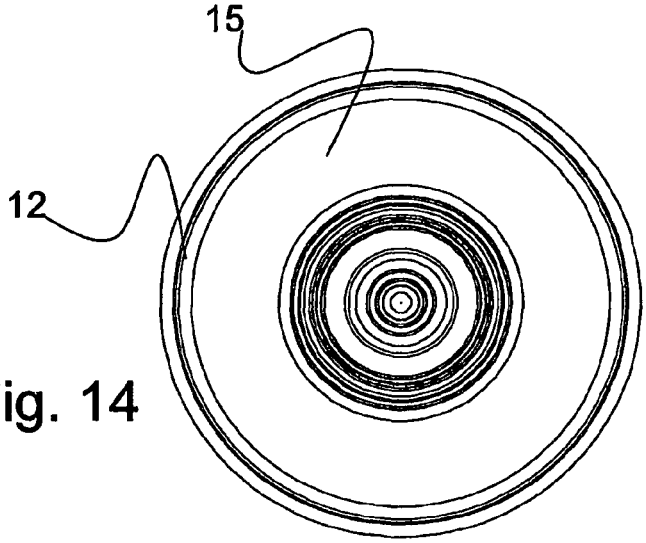
FIG. 14 shows in a bottom view the connecting element.

FIGS. 12-14 shows the connecting element 12 in a side view, a top view and a bottom view, respectively.

Figure 15:
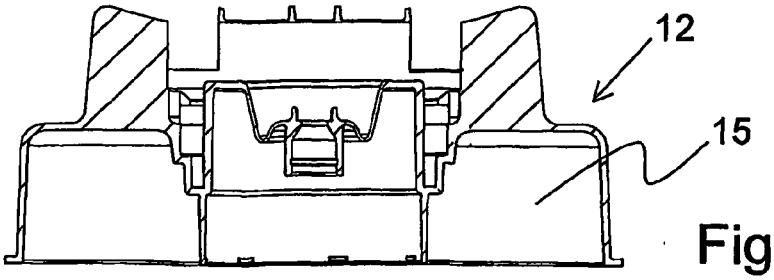
FIG. 15 shows a first side sectional view of the connecting element.
Figure 16:
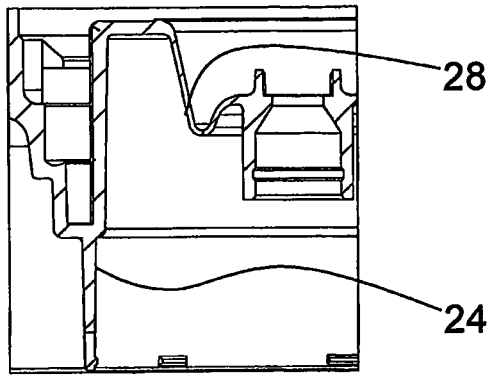
FIG. 16 shows an enlarged detailed sectional view of a part of the connecting element.

FIG. 15 shows a cross-sectional side view of the connecting element 12. FIG. 16 shows a detailed area of the collar 28 and the wall 24.

Figure 17:
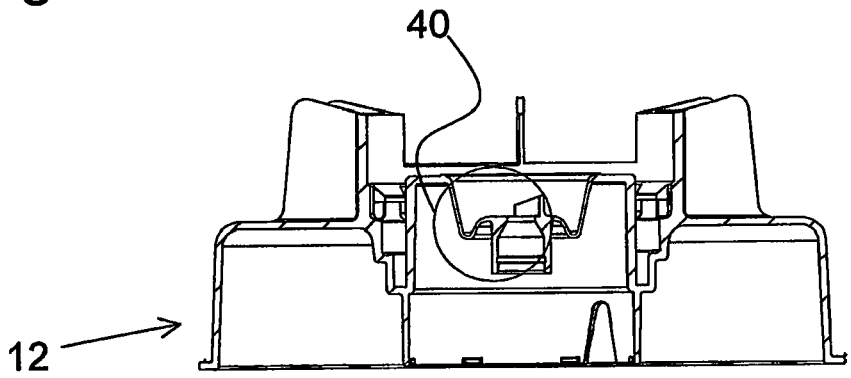
FIG. 17 shows a second side sectional view of the connecting element.

FIG. 17 shows a cross-sectional side view of the connecting element 12.

Figure 18:
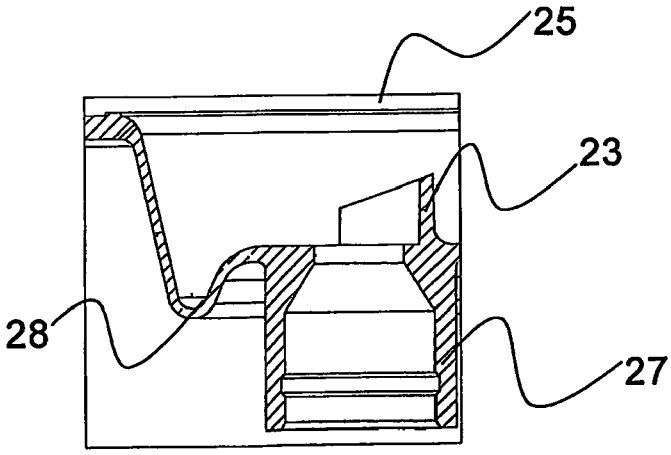
FIG. 18 shows an enlarged sectional view of the encircled area in FIG. 17.

The encircled area 40 in FIG. 17 is shown enlarged in FIG. 18 and again shows in detail the receiving means 27, the piercer 23 arranged for piercing of the membrane 25 and the flexible collar 28.

Preferably the piercer 23 has means for abutment on the lid 6, while the lid 6 has corresponding abutment means. This allows the piercer 23 to open the beverage container by piercing the membrane 25 automatically when the beverage container is forced downwards towards the lid 6 of the pressure chamber 2, since the abutment with the lid forces the piercer 23 to move relative to the connecting element 12. The need to manually handle the opening of the beverage container before placing the beverage container in the assembly 1, 1' is thus avoided. The matter is that when the pressure chamber 2 is being placed in the operating position, i.e. a vertical position with the beverage container placed upside down with the connecting element at the lower end as shown in FIG. 4, the weight of the beverage container will force the connecting element 12 towards the lid 6 of the pressure chamber. At the same time a pressure is starting to build up inside the pressure chamber, which also will force the connecting element towards the lid, thus the connecting element 12 will function as a piston against the lid, in which case the abutment means of the lid will force the piercer via the flexible collar towards the membrane which will be pierced and an opening to beverage is obtained.

The collar 28 may be provided with one or more slits (not shown) and is preferably constructed in the same material as the other parts of the piercer 23. The slits of the collar 28 provide resiliency to the collar 28, and cause the collar 28 to flex outwards, when the piercer 23 is forced towards the beverage container to pierce the membrane 25. Furthermore, the inlet end of the dispensing line may be arranged as a piercer (not shown) so that it is the inlet end of the dispensing line which pierce the membrane.

The parts of the connecting element 12 are preferably made in a plastic material such as PET, PE, PET or PP or a combination thereof. This allows for low construction costs, and further allows the parts to be grinded and recycled for new plastics products, e.g. new connecting elements. The membrane can be glued or welded to the connecting element. The material for these membranes can e.g. be a plastic, a plastic coated paper, paper, aluminum foil.

Figure 21:
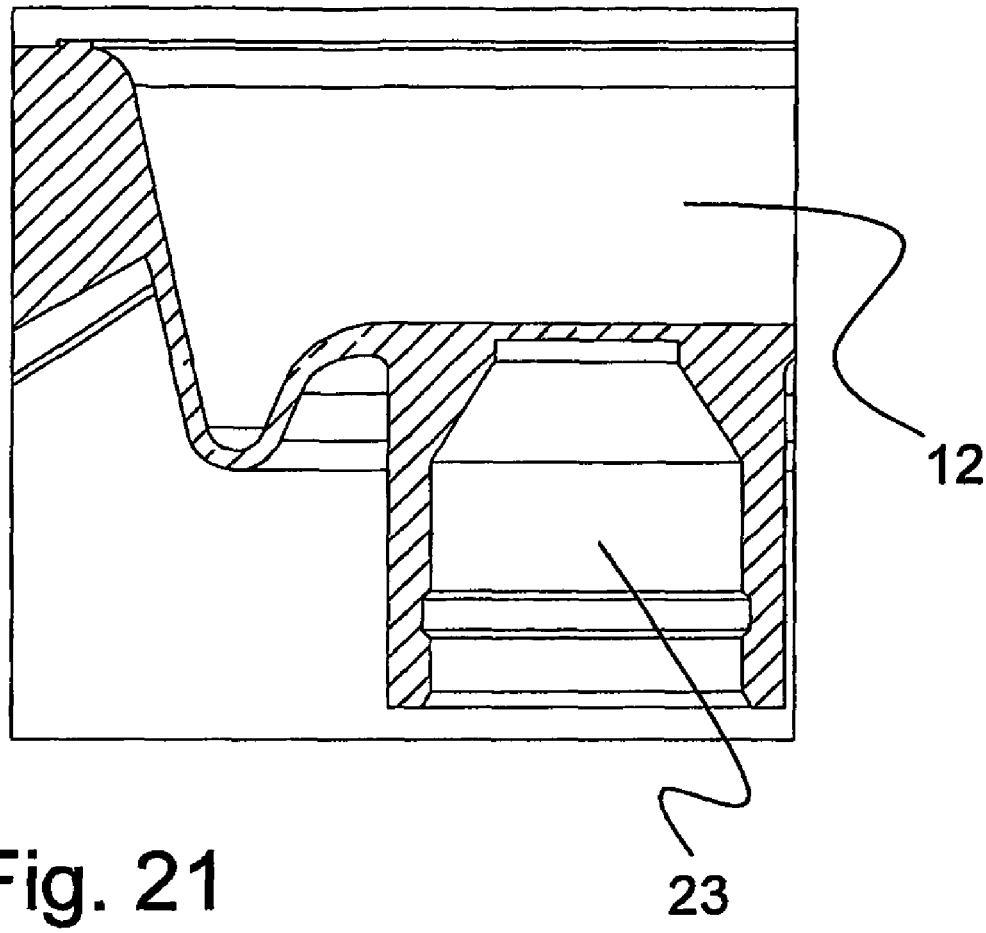
FIG. 21 shows a sectional view of a particular embodiment of the connecting element and the receiving means.

Additionally, a second membrane may be arranged as a part of the connecting element 12. This membrane may be made of a polymer material, such as PET, and may be an integral part of the connecting element 12. The second membrane may preferably be arranged outside the first membrane in relation to the inside of the beverage container 11, and may thus be the first membrane to be penetrated by the piercer 23. The piercer 23 may optionally be adapted specifically for interaction with such a second membrane. For instance, the piercer 23 may be made of metal in order to secure proper penetration of the membranes. FIG. 21 shows a sectional view of a part of a connecting element 12. In FIG. 21 the part of the piercer 23 pointing towards the membranes and the beverage container is shown as being flat. This may be an advantageous form for a metal piercer 23.

Furthermore, the structure of the connecting element 12 adapted for cooperation with the lid of the pressure chamber, allows the beverage container when said connecting element being mounted on the neck of the beverage container to stand upright with the outlet of the container facing downwards. The connecting element 12 allows the beverage container to stand on the lid as well as on any other surface without any risk of damaging the outlet of the beverage container, since the outer wall of the connecting element extends beyond the neck part of the beverage container.

Additionally, this leaves the upper end of the generally cylindrical collapsible beverage container opposing the outlet end to be shaped in a manner for optimal collapsing performance.

The substantially flat connecting element 12 simplifies the installation of the beverage container in the pressure chamber considerably, since the beverage container need not be manoeuvred over the walls of the dispensing assembly, as is the case with the prior art assemblies. Thereby the structure allows for easy placement of even large beverage containers.

Figure 19:
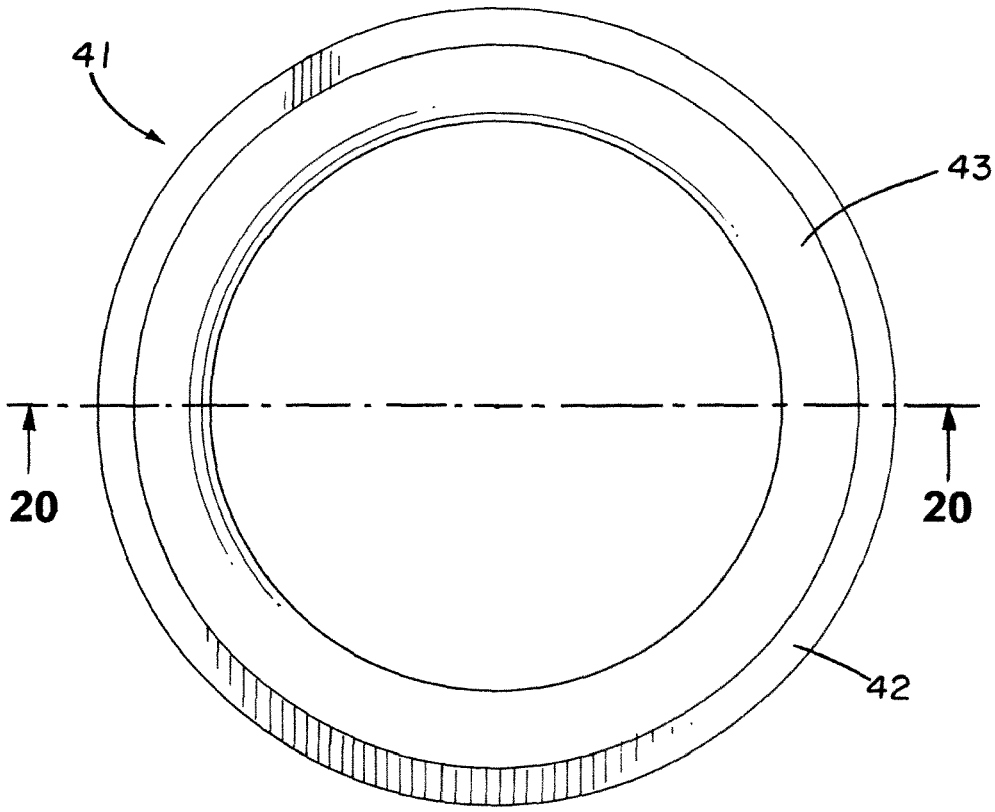
FIG. 19 shows a sealing element in a top view.
Figure 20:
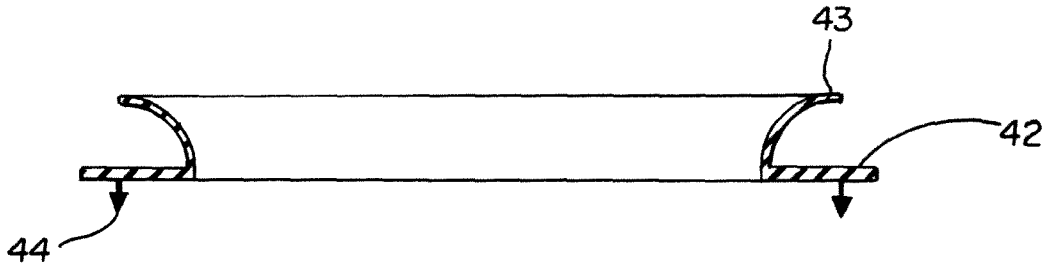
FIG. 20 shows a cross-sectional view of the sealing element shown in FIG. 19.

FIGS. 19 and 20 show a sealing element 41 in a top view and a cross-sectional side view taken by the line 20-20 in FIG. 20, respectively. The sealing element 41 is formed as a ring and comprises a main part 42, an annular lip 43 and a plurality of taps 44 placed around the main part 42 with a mutual spacing on the opposite side of the lip 43. During use of the assembly, when the beverage container has been loaded into the pressure chamber and the pressure chamber is placed in the use position, i.e. the vertical position of the beverage container, the beverage container will start to move downwards against the lid of the pressure chamber. The connection element 12 will during this movement first come into contact with the lip 43 of the sealing element 41, whereby a sealing is obtained and a pressure may be built up. The connection element 12 continues its movement towards the lid and will thereby push the lip 43 down towards the main part 42 of the sealing element 41. As the pressure builds up in the pressure chamber the connecting element will be forced towards the lid and the sealing element 41 will provide a proper sealing between the lid and connecting element. Furthermore, due to the design of the sealing element 41 the sealing element 41 will easily release from the connecting element when the beverage container is removed from the pressure chamber.

In addition, the sealing element may also have other geometrical configurations such as circular (e.g. an O-ring), square, elliptic, or any combination thereof, and being made of a material, which facilitates sealing such as rubber materials.

Although the invention above has been described in connection with preferred embodiments of the invention, it will be evident for a person skilled in the art that several modifications are conceivable without departing from the invention as defined by the following claims.

The invention claimed is:

1. An assembly (1, 1') for dispensing a beverage, said assembly(1, 1') comprising:

a beverage container (11) made of a collapsible material and comprising a neck part (13) having an outlet;

a connecting element (12) arranged at the neck part (13) and comprising a receptacle (27) configured for receiving an inlet end (22) of a dispensing line (19); and a pressure chamber (2) having an interior configured to accommodate the beverage container (11), the pressure chamber (2) comprising a wall (5) and a lid (6) defining the interior of the pressure chamber (2);

wherein the connecting element (12) is configured for abutment with the lid (6) of the pressure chamber (2) to form a seal between the lid (6) and the beverage container (11);

wherein the connecting element (12) comprises a disc-shaped part (32) having a first surface (33), a second surface (35), and a wall part (34), the wall part (34) being circumferential to and extending from the second surface (35) and substantially perpendicular to the second surface (35); and wherein the first surface (33) of the disc shaped part (32) of the connecting element (12) comprises locking means (36) for connecting the connecting element (12) to the neck part (13) of the beverage container (11).

2. The assembly of claim 1, wherein the connecting element (12) has an overall width and the beverage container (11) has a width, wherein the overall width of the connecting element (12) is smaller than the width of the beverage container (11).

3. The assembly of claim 1, wherein the locking means (36) comprises a first annular space (37) arranged between an outer circular wall (38) and an inner circular wall (24), the outer wall (38) and the inner wall (24) being arranged concentrically.

4. The assembly of claim 3, wherein the first annular space (37) extends through the disc-shaped part (32).

5. The assembly of claim 3, wherein the neck part (13) includes an outer side having a first plurality of projections, wherein the outer circular wall (38) comprises an inward surface and an outward surface, and wherein the inward surface comprises a second plurality of projections configured to engage with the first plurality of projections on the outer side of the neck part (13).

6. The assembly of claim 5, wherein the outward surface of the outer circular wall (38) comprises supporting means (17) for supporting the outer wall (38) in a radial direction to provide a rigid connection between the neck part (13) and connecting element (12).

7. The assembly of claim 6 wherein the supporting means (17) comprises a plurality of ribs arranged around the outer wall (38).

8. The assembly claim 1, wherein the locking means (36) comprises a sealing ring (31).

9. The assembly of claim 3, wherein the inner circular wall (24) is configured for insertion into the outlet of the neck part (13).

10. The assembly of claim 9, wherein a gastight membrane (25) is arranged in connection with the inner circular wall (24).

11. The assembly of claim 10, wherein a piercer (23) is arranged inside the inner circular wall (24) at a predetermined distance from the membrane (25), the piercer (23) being configured and located to pierce the membrane (25) when a predetermined pressure is obtained inside the pressure chamber (2).

12. The assembly of claim 11, wherein the piercer (23) is an integral part of the connecting element (12).

13. The assembly of claim 11, wherein the inlet end (22) of the dispensing line (19) is arranged in connection with the piercer (23).

14. The assembly of claim 3, wherein the second surface (35) of the disc-shaped part (32) comprises the inner circular wall (24), said inner circular wall (24) being arranged inside said wall part (34), and whereby a second annular space (15) is arranged between said wall part (34) and said inner circular wall (24).

15. The assembly of claim 14, wherein the inner circular wall (24) defines a compartment (26) in which are arranged receiving means (27) for the inlet end (22) of the dispensing line (19).

16. The assembly of claim 15, wherein the receiving means (27) is arranged in connection with a flexible collar (28) that is operable to move the piercer (23) into a piercing position when the predetermined pressure is obtained inside the pressure chamber (2).

17. The assembly of claim 14, wherein the second annular space (15) is engageable with corresponding connecting means (16) on the inside of the lid (6) of the pressure chamber (2).

18. The assembly of claim 17, wherein a sealing element (41) is arranged in the second annular space (15).

19. The assembly of claim 1, wherein the connecting element (12) is made of a plastic material.

* * * * *

UNITED STATES PATENT AND TRADEMARK OFFICE

CERTIFICATE OF CORRECTION

PATENT NO. : 8,360,277 B2
APPLICATION NO. : 12/063509
DATED : January 29, 2013
INVENTOR(S) : Jan N. Rasmussen It is certified that error appears in the above-identified patent and that said Letters Patent is hereby corrected as shown below:

In the Specifications

In column 1, line 6, delete "entry." and insert -- entry, --, therefor.

In column 1, line 7, delete "§371(c)." and insert -- §371(c), --, therefor.

In column 2, line 11, delete "plastics" and insert -- plastic --, therefor.

In column 2, line 12, delete "space." and insert -- space, --, therefor.

In column 2, line 31, delete "costs" and insert -- costs, it --, therefor.

In column 2, line 32, delete "emptied." and insert -- emptied, --, therefor.

In column 2, line 67, delete "con- tainer." and insert -- container. --, therefor.

In column 4, line 24, delete "pivoted." and insert -- pivoted, --, therefor.

In column 5, line 35, delete "2." and insert -- 2, --, therefor.

In column 5, line 57, delete "l" and insert -- 1' --, therefor.

In column 7, lines 51-52, after "neck" delete "These projections may be in engagement with projections arranged on the outer side of the neck.".

In column 8, line 18, delete "sup- port" and insert -- support --, therefor.

In column 9, line 28, delete "PET" and insert -- PBT --, therefor.

Signed and Sealed this
Eleventh Day of June, 2013

Teresa Stanek Rea
*Acting Director of the United States Patent and Trademark Office*